US005519424A

United States Patent [19]

Scardovi et al.

[11] Patent Number: 5,519,424

[45] Date of Patent: May 21, 1996

[54] INK JET PRINT HEAD

[75] Inventors: Alessandro Scardovi, Ivrea; Roberto Morandotti, Mercenasco, both of Italy

[73] Assignee: Ing. C. Olivetti & C., S.p.A., Italy

[21] Appl. No.: 400,453

[22] Filed: Mar. 7, 1995

Related U.S. Application Data

[63] Continuation of Ser. No. 987,799, Dec. 9, 1992, abandoned.

[30] Foreign Application Priority Data

Dec. 24, 1991 [IT] Italy ..... TO91A1033

[51] Int. Cl.[6] ..... B41J 2/05

[52] U.S. Cl. ..... 347/65; 347/47

[58] Field of Search ..... 347/65, 63, 47, 347/85

[56] References Cited

U.S. PATENT DOCUMENTS

| | | | |
|---|---|---|---|
| 4,314,259 | 2/1982 | Cairns et al. | 347/75 |
| 4,550,326 | 10/1985 | Allen | 347/44 |
| 4,558,333 | 12/1985 | Sugitani | 347/65 |
| 4,638,328 | 1/1987 | Drake et al. | 347/75 |
| 4,882,595 | 11/1989 | Trueba | 347/65 |
| 4,937,597 | 6/1990 | Yasuhara et al. | 347/70 |
| 5,198,834 | 3/1993 | Childers | 347/65 |

FOREIGN PATENT DOCUMENTS

| | | | |
|---|---|---|---|
| 237282 | 9/1987 | European Pat. Off. | B41J 3/04 |
| 438270 | 7/1991 | European Pat. Off. | B41J 2/14 |

OTHER PUBLICATIONS

Patent Abstract of Japan No. JP 60–139,455 (Fujitsu KK).
Patent Abstract of Japan No. JP 57–165,265 (Matsushita Denki Sangyo KK).
2244 Research Disclosure, Jul. 1987, No. 279, New York.

*Primary Examiner*—Joseph W. Hartary
*Attorney, Agent, or Firm*—Banner & Allegretti, Ltd.

[57] ABSTRACT

An ink jet print head in which the ink contained in a chamber is expelled through a nozzle in the form of droplets by the rapid heating of a heating element inside the chamber. The chamber is of polygonal form and communicates with an ink supply channel disposed at a corner of the chamber.

1 Claim, 5 Drawing Sheets

INK JET PRINT HEAD

This is a continuation of co-pending application Ser. No. 07/987,799, filed on Dec. 9, 1992, now abandoned.

BACKGROUND OF THE INVENTION

The present invention relates to an ink jet print head and in particular to print heads of the type in which droplets of ink are expelled from a nozzle by rapid heating of a resistive element contained within an ink collecting chamber and disposed next to the nozzle.

The ink collecting chamber and the resistive element are formed within a multi-layer board constructed on a silicon base using well known methods of construction of integrated circuits. The nozzles are constructed, by an electroforming process, in a metal sheet fixed against the multi-layer board, as is described, for example, in European patent application published under No. 401996 in the name of the applicant.

Such print heads are usually provided with a plurality of nozzles and their associated chambers in a vertical row. The print head is moved transversely across a piece of paper and the resistive elements are selectively energised to expel droplets of ink by electrical pulses at predetermined intervals which are limited by a maximum repetition frequency. Characters are thereby printed on the paper.

During rest periods and/or in the interval between two consecutive pulses, it is necessary that the collecting chambers remain completely filled with ink and that the ink forms a stable meniscus in the nozzle. This meniscus should be in equilibrium with the depression in the reservoir of ink in the chamber supply system.

The maximum frequency of operation of such a head is limited by the time taken to replenish the ink in the collecting chamber after the expulsion of a droplet, and by the time taken to damp out the vibrations of the meniscus to return to the equilibrium state.

The time taken to replenish the ink in a chamber is primarily dependent on the hydraulic resistance of the supply duct, while the damping of the meniscus also depends on the lag of the moving body of ink.

One method of modifying the lag of the supply channel in order to improve the performance of a print head-of the type mentioned above, and in particular to reduce the reciprocal interference between the different collecting chambers, is known from European Patent Application No. 314486.

In this the supply channels connecting the reservoir to the collecting chambers each have a constriction. This arrangement, however, has the disadvantage of also increasing the hydraulic resistance of the channel, which reduces the maximum repetition frequency of the expulsion of ink droplets.

SUMMARY OF THE INVENTION

Preferred embodiments of the present invention provide an ink jet print head which has a polygonal ink collecting chamber for supplying a nozzle. The chamber is in communication with an ink reservoir via at least one supply channel. Each supply channel enters the chamber at an apex between at least two walls of the polygon. This arrangement reduces the parasitic lag caused by ink adjacent the entry of the supply channel into the chamber and increases the maximum droplet expulsion frequency without altering the damping of the vibrations of the meniscus in the nozzle.

The invention is defined with more precision in the appended claims to which reference should now be made.

A preferred embodiment of the invention will now be described in detail by way of example with reference to the accompanying drawings in which.

Figure 7A:
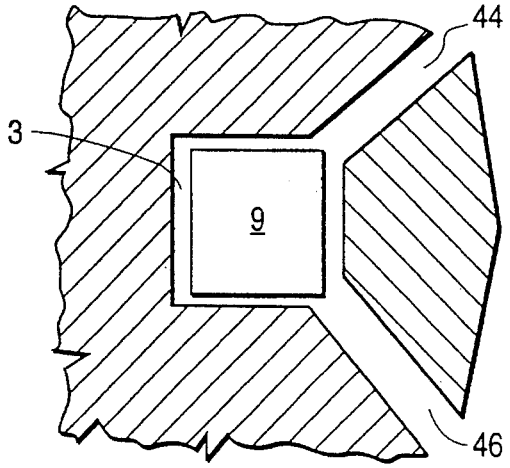
Figure 7B:
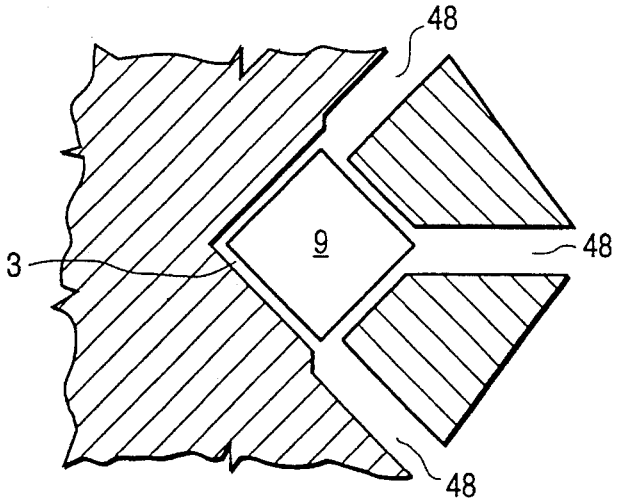
Figure 7C:
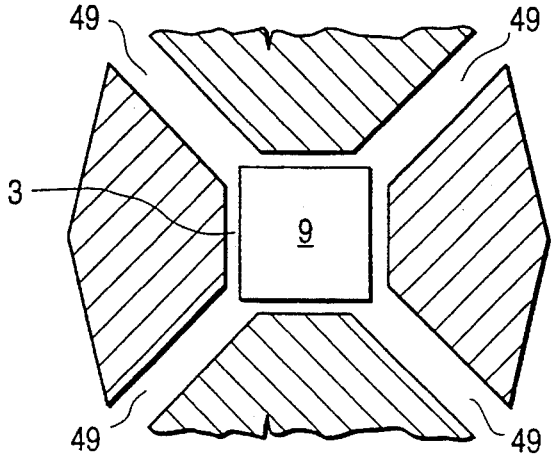
Figure 9:
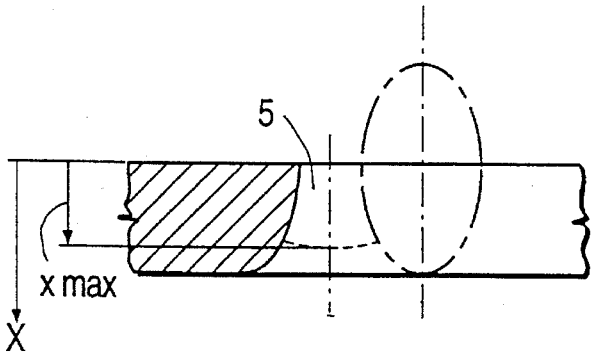
Figure 10:
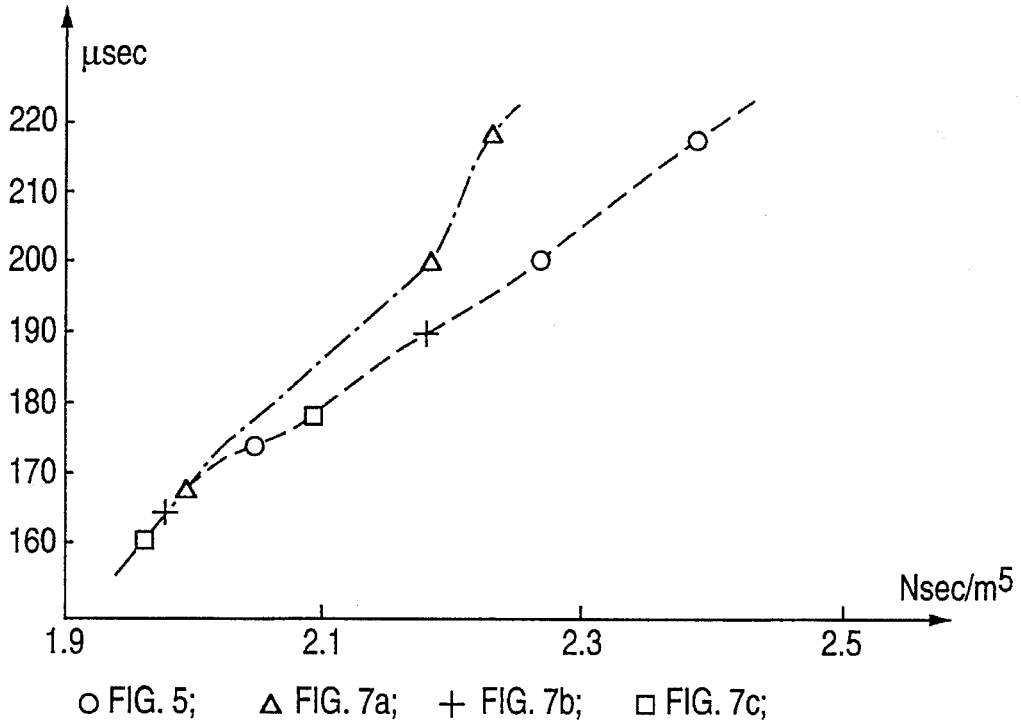
Figure 11:
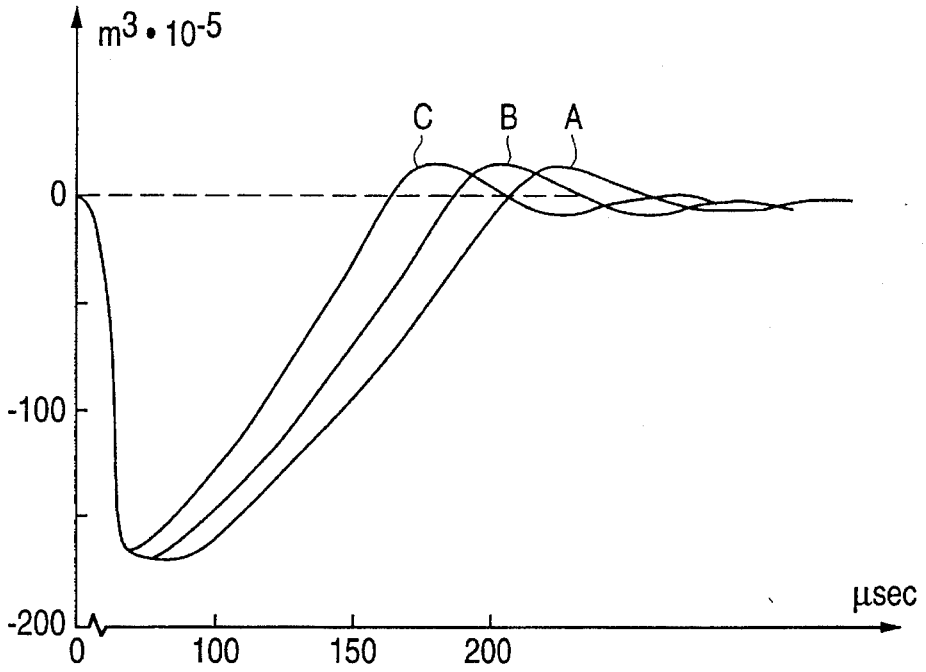

FIGS. 7*a*, 7*b*, and 7*c* show further alternative forms of ink collecting chambers embodying to the invention;

FIG. 9 is a diagrammatic illustration of profiles of a nozzle;

FIG. 10 is a graph of the replenishing time of chambers embodying the invention;

FIG. 11 is a graph of the damping of the meniscus vibrations in chambers embodying the invention.

DETAILED DESCRIPTION OF A PREFERRED EMBODIMENT

Figure 1:
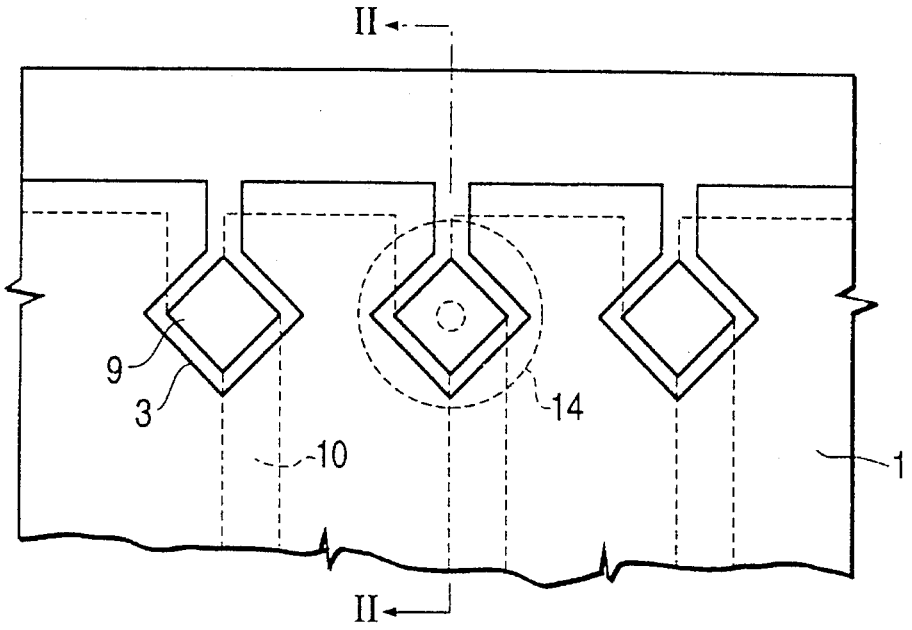
FIG. 1 is a plan view of the collecting chambers of an ink jet head embodying embodiment of the invention.
Figure 2:
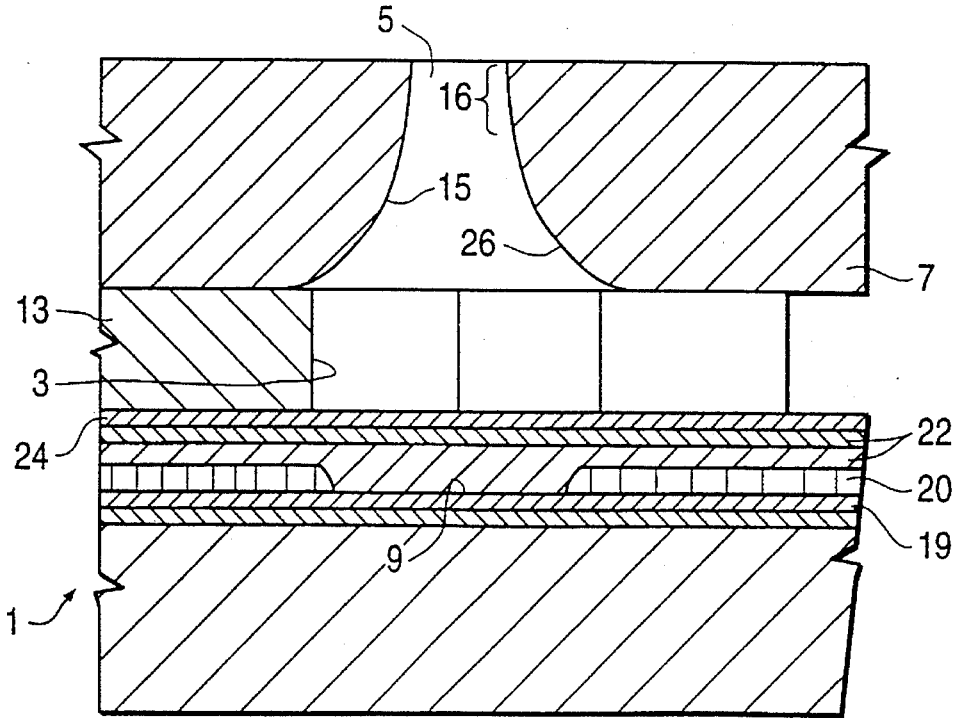
FIG. 2 is a section along the line II—II in FIG. 1.

With reference to FIGS. 1 and 2, a multi-layer board 1 for use in an ink jet print head comprises a plurality of metallic layers and electrically insulating layers. On the board each layer is constructed by procedures of vacuum deposition and electroforming which are known in the art.

In use ink is contained in collecting chambers 3 formed in a resin layer 13 of the board 1, and is expelled through nozzles 5 formed through a metal sheet 7 fixed on the resin layer 13.

The expulsion of a droplet of ink is achieved by the rapid heating of a heating element 9 disposed next to a chamber 3 and formed by a layer 19 of resistive tantalum-aluminium material.

Each heating element or resistance is activated by means of electrical pulses applied selectively to tracks 10 (FIG. 1) formed from a layer 20 (FIG. 2) of aluminium superimposed on the layer 19 with apertures next to the chambers 3.

The tracks 10 are covered by one or more layers 22 of insulating material, protected in turn by a protective layer 24 of tantalum, which forms the base of each chamber 3.

Figure 5:
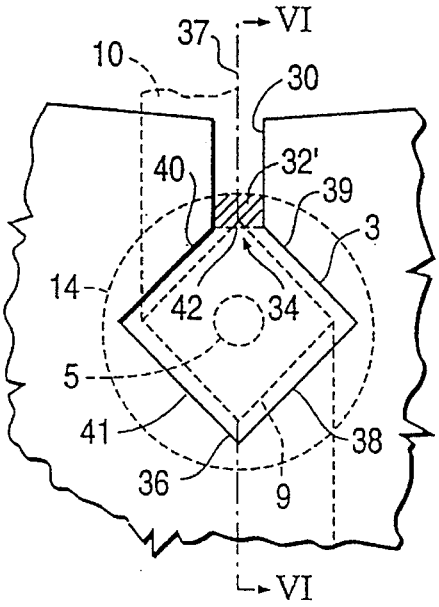
FIG. 5 is a plan view of a collecting chamber embodiying the invention.

The profiles of the internal surfaces 15 of the nozzles 3 (FIG. 2) have a longitudinal section in a form approximating an arc of a circle or preferably in a form approximating an arc of an ellipse. In the latter case, the terminal area 16, near the outlet portion, may be of substantially cylindrical form. The cylindrical profile of the terminal area 16 is connected to the chamber 3 via a flared profile 26 opening into a bell shape until it comes into contact with the resin layer 13. It thereby defines a connecting circle 14 (FIGS. 1, 3, 5).

As a result of the wide flaring 26 of the lower part of the nozzle 5, the periphery of the chamber 3 lies entirely within the circle 14 forming the connection with the resin layer 13 as can be seen from FIG. 1.

Figure 3:
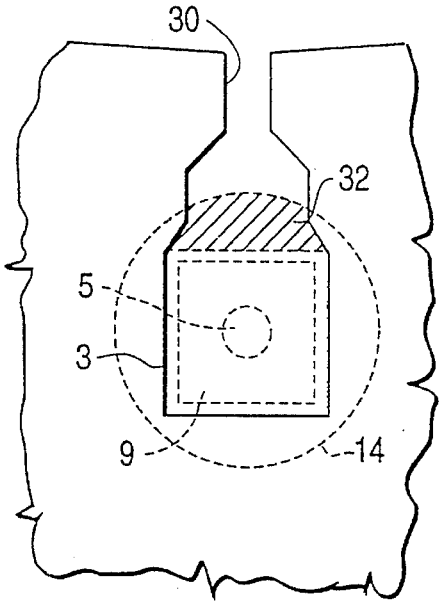
FIG. 3 PRIOR ART
FIG. 3 and 4 are a plan view and section view respectively of a collecting chamber of the conventional type.
Figure 4:
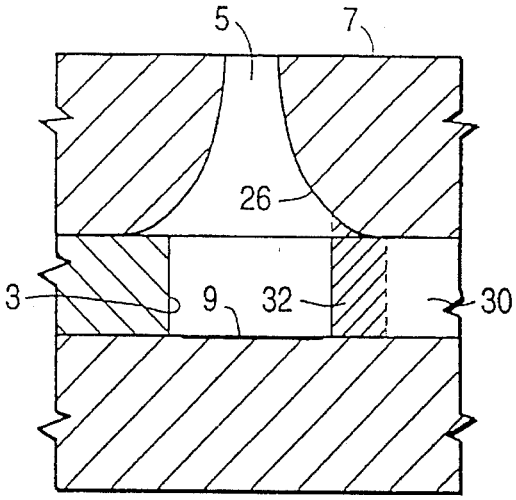
FIG. 4 PRIOR ART

In a conventional ink jet print head known in the art, for example that illustrated in FIGS. 3 and 4, the chambers 3 each have a substantially square shape. A supply channel 30 is connected to a chamber 3 through one of the walls of the chamber and is perpendicular to the chamber.

Because of the flaring 26 of the nozzle 5 above the chamber 3 a body of ink 32 is contained in the portion of channel which lies below the said flaring, and is shown by hatching in FIGS. 3 and 4. During the stage of replenishing the ink in the chamber 3, following the projection of an ink droplet, this body of ink 32 acts as a parasitic lag, which is added to the lag of the ink within the supply channel 30.

In order to maintain the damping-of the oscillations of the meniscus in the nozzle 5 below a given critical value, therefore, the hydraulic resistance of the supply channel must have high values which are such that they significantly increase the time taken to replenish the ink.

This results in a limitation of the repetition frequency of the expulsion of the ink droplets.

We have appreciated that this disadvantage can be overcome by selecting a more favourable orientation of the chamber 3 with respect to the supply channel.

In a preferred embodiment the chamber 3, when seen in plan (FIG. 5), is of substantially square quadrangular form, disposed with two opposite corners 34 and 36 aligned with the axis 37 of the supply channel 30. Consequently the sides, representing the lateral walls 38, 39, 40, 41 of the chamber 3 are inclined symmetrically with respect to the axis 37 of the channel. The channel 30, as shown clearly in the figures, opens into the chamber 3 at one corner 34.

Figure 6:
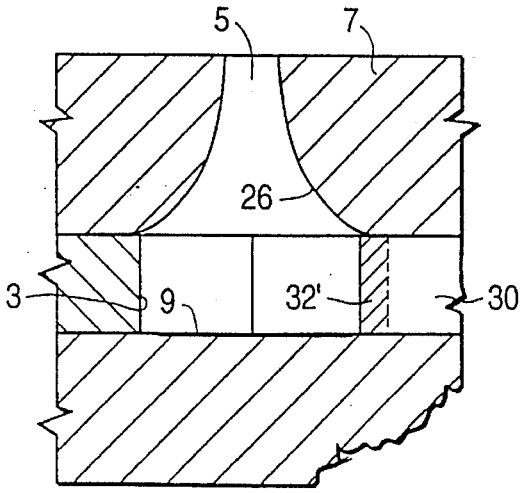
FIG. 6 is a section along the line VI—VI in FIG. 5.

Consequently the connecting section 42 between the channel and the chamber is very much closer to the circle 14 forming the connection between the flaring 16 of the nozzle and the resin layer 13, so that the body of ink 32' (FIGS. 5 and 6) still contained in the portion of channel below the flaring 16 is reduced. This disposition provides a considerable improvement in the frequency response of the head, making it possible in this example to obtain an ink replenishing time within the chamber 3 of the order of 175 μs, corresponding to a frequency of approximately 5700 Hz.

The reduced parasitic lag of the body of ink 32' contained below the flaring 16 enables the supply channel 30 to be designed with a constant transverse section and with a very low hydraulic resistance, while retaining optimal meniscus damping conditions.

By way of example, the dimensions of the channel 30 are: width=height=25 μm; length between 30 and 50 μm. The damping factor Z=R/Rc, where R is the effective hydraulic resistance of the channel 30 and Rc is the critical resistance, was chosen to be between Z=0.3 and 0.7 Rc is given by the known equation $$Rc = 2\frac{L}{C}$$

where L and C are the lag of the channel and the equivalent capacity of the meniscus respectively.

Additionally, for a supply channel with a constant rectangular section along its extension, the ratio between the lag and the hydraulic resistance is known to be proportional to the square of the width of the channel.

It follows from this that a smaller ratio of lag to hydraulic resistance is obtained by reducing the width of the channel, and that consequently it is possible to design the channel so as to obtain a relatively low resistance without altering the conditions of damping of the meniscus oscillations.

In this way, a greater ink velocity in the channel is obtained, for the same damping conditions., during the replenishing stage. This is equivalent to an increase in the obtainable repetition frequency.

However, since the width of the channel cannot, owing to technical difficulties, be reduced to less than the height of the channel, in other words to the thickness of the resin layer 13, the obtainable increase in frequency is thereby limited.

FIGS. 7*a*, 7*b*, and 7*c* show various further embodiments of the invention.

FIG. 7*a* shows a chamber 3 of quadrangular form connected to two supply channels 44 and 46, located at two adjacent corners and aligned substantially with two diagonals of the chamber.

Since the two channels 44 and 46 supply the chamber 3 in parallel, their equivalent hydraulic resistance and lag are half of the corresponding values obtainable in the case of a single channel, as in the case shown in FIG. 5.

The lengths of the channels 44 and 46 may therefore be increased and, at the limit, doubled, without adversely affecting the frequency response compared with the configuration in FIG. 5 with only one channel.

Moreover, the parasitic lags of the bodies of ink contained at the outlets of the channels into the chamber under the flaring of the nozzle are also halved.

This fact contributes to an increase in the frequency response of the chamber, again compared with the configuration in FIG. 5.

In the case of the configuration in FIG. 7*a* in which the dimensions of the section of the channels 44 and 46 are equal to those of the channel 30 in FIG. 5, while their length is approximately 70–80 μm, a replenishing time of 168 μs was obtained, corresponding to a repetition frequency of approximately 5950 Hz.

FIGS. 7*b* and 7*c* show a chamber 3 supplied by three channels 48 and by four channels 49 respectively.

The channels 48 and 49 enter the chamber 3 at the corners and are orientated substantially along the diagonals of the chamber.

For the configuration in FIG. 7*b* with three channels, a replenishing time of 165 μs and a repetition frequency of approximately 6060 Hz were obtained, while for the configuration in FIG. 7*c* the replenishing time is 163 μs and the frequency is 6130 Hz.

Figure 8:
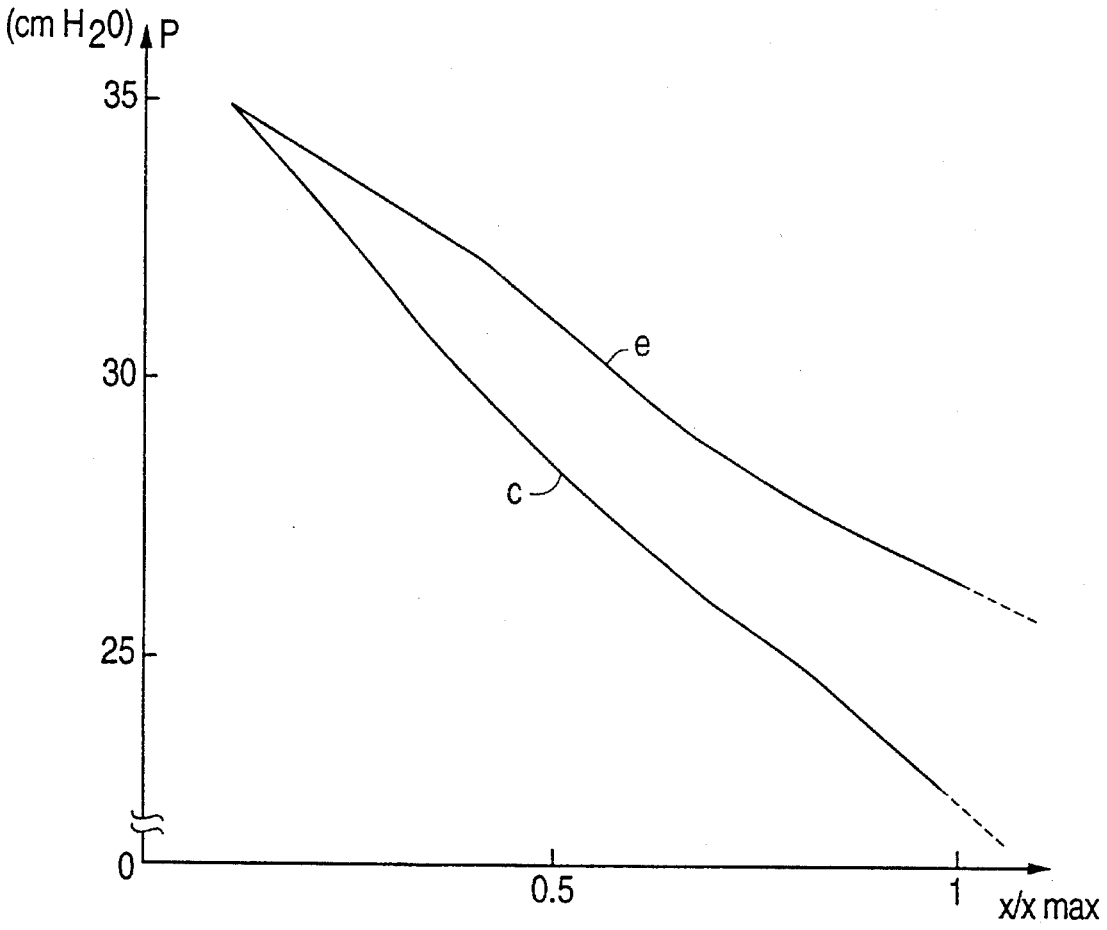

FIG. 8 is an experimental graph of the capillary depression P (on the ordinate) of the meniscus in the case of a nozzle with a provile in the form of an arc of a circle (curve c) and an arc of an ellipse (curve e). It should be noted that in the case of a profile in the form of an arc of an ellipse, the ellipse is disposed (FIG. 9) with the greater axis parallel to the axis of the nozzle 5.

In the graph in FIG. 8, the abscissae represent the travel "x" of the meniscus within the nozzle (FIG. 9).

It may be seen from the graph in FIG. 8, therefore, that greater capillary depressions are obtained with the nozzle with an elliptical profile than those obtained with the circular profile, and that this contributes to a better frequency response of the head, since the replenishing time is substantially proportional to the capillary depression of the meniscus.

FIG. 10 is an experimental graph of the variation in the replenishing time Tr as a function of the resistance R of the supply channel, for the configuration in FIGS. 5, 7*a*, 7*b* and 7*c*.

It will be seen from the graph that the replenishing time varies in a substantially linear way with the hydraulic resistance of the channel 30, expressed in $Ns/m^5$.

FIG. 11 shows the characteristic damping curves for a conventional configuration as in FIG. 3 (curve A), the configuration in FIG. 5 in which the width of the channel 30 is 30 μm (curve B), and the configuration in FIG. 7*a* (curve C).

Curves B and C confirm the improvement in the frequency performance (reduction of the replenishing time) of the corresponding configurations compared with the conventional configuration in FIG. 3.

It should be understood that the configurations of the collecting chambers and of the associated supply channels described above with reference to the attached drawings may be modified in their forms and varied in their relative dispositions without thereby departing from the scope of the present invention.

We claim:

1. An ink jet print head comprising:

base substrate;

a chamber layer overlaying said substrate and having formed therein at least an ink chamber and an ink supply channel, said chamber being delimited by walls disposed in a polygonal form and perpendicular to said layer;

a nozzle plate overlaying said chamber layer, said nozzle plate including at least a nozzle communicating with said chamber and delimited by an internal surface wet by the ink, said nozzle extending along a longitudinal axis perpendicular to said layer;

an expulsion element in said chamber, facing said nozzle and selectively activated for expelling ink droplets from said nozzle at an operating frequency;

said ink supply channel, extending in said layer in a direction parallel to said layer with a constant cross section, and being connected to the chamber at a corner thereof between two adjacent walls, through a connecting cross-sectional surface perpendicular to said direction, located between the channel and said chamber, whereby an overlap of said nozzle and said channel is reduced to lessen a replenishing lag associated therewith;

said internal surface defining an arcuated profile formed by an arc of an ellipse having the greater axis parallel to the axis of the nozzle in a plane parallel to said longitudinal axis and forming a circular conjunction line on a surface between said nozzle plate and said chamber layer, adjacent said connecting surface, and a body of ink still contained in a portion of said channel comprised between said connecting cross-sectional surface and below said circular conjunction line being so reduced, that the operating frequency of said head is increased.

* * * * *